US011793718B2

(12) United States Patent
Folchini et al.

(10) Patent No.: US 11,793,718 B2
(45) Date of Patent: Oct. 24, 2023

(54) CONTAINER, PARTICULARLY FOR MEDICAL PRODUCTS, PHARMACEUTICALS, COSMETICS, FOOD OR THE LIKE

(71) Applicant: Lameplast, S.R.L., Novi de Modena (IT)

(72) Inventors: Enrico Folchini, Novi di Modena (IT); Enrico Salvarani, Novi di Modena (IT); Filippo Fangarezzi, Novi di Modena (IT)

(73) Assignee: Lameplast, S.R.L., Novi di Modena (IT)

( * ) Notice: Subject to any disclaimer, the term of this patent is extended or adjusted under 35 U.S.C. 154(b) by 487 days.

(21) Appl. No.: 16/965,099

(22) PCT Filed: Feb. 18, 2019

(86) PCT No.: PCT/IB2019/051296
§ 371 (c)(1),
(2) Date: Jul. 27, 2020

(87) PCT Pub. No.: WO2019/159147
PCT Pub. Date: Aug. 22, 2019

(65) Prior Publication Data

US 2021/0030622 A1 Feb. 4, 2021

(30) Foreign Application Priority Data

Feb. 16, 2018 (IT) ..... 102018000002752

(51) Int. Cl.
*A61J 1/06* (2006.01)
*B65D 51/16* (2006.01)
(Continued)

(52) U.S. Cl.
CPC ..... *A61J 1/067* (2013.01); *B65D 51/1616* (2013.01); *A61J 1/145* (2015.05); *B65D 1/095* (2013.01); *B65D 2221/00* (2013.01)

(58) Field of Classification Search
CPC ..... B65D 1/095; B65D 51/1616; A61J 1/067
See application file for complete search history.

(56) References Cited

U.S. PATENT DOCUMENTS 9,908,677 B2 * 3/2018 Shi ..... B65D 75/5811
2014/0197207 A1 7/2014 Pozzi
2016/0311588 A1 * 10/2016 Wochele ..... A61J 1/1412

FOREIGN PATENT DOCUMENTS

DE 102013226253 A1 6/2015
DE 102014201697 A1 6/2015
(Continued)

OTHER PUBLICATIONS

International Search Report and Written Opinion in international application No. PCT/IB2019/051296 dated May 3, 2019.

*Primary Examiner* — Anthony D Stashick
*Assistant Examiner* — Raven Collins
(74) *Attorney, Agent, or Firm* — Polsinelli, P.C.

(57) ABSTRACT

The container (1), particularly for medical products, pharmaceuticals, cosmetics, food or the like, comprises:

an hollow body (2) at least partly compressible defining a chamber (3) for containing a fluid product (4) and provided with a neck (5);

a closure element (6) made in a single body piece with the hollow body (2) and provided with an attachment portion (7) which, in a packaging configuration, is associated with the hollow body (2) along a predefined breaking line (8) adapted to allow the separation of the closure element (6) from the hollow body (2) in a configuration of separation in which on the hollow body (2) is formed a dispensing opening (9) of the fluid product (4);

(Continued)

a dispensing valve (13) adapted to allow the outflow of the fluid product (4) through the dispensing opening (9); and a return valve (14) adapted to allow the one-way flow of air (15) towards the chamber (3), wherein the return valve (14) comprises filtering means (16) adapted to filter the air (15) entering the chamber (3).

11 Claims, 10 Drawing Sheets

(51) Int. Cl.
*B65D 1/09* (2006.01)
*A61J 1/14* (2023.01)

(56) References Cited

FOREIGN PATENT DOCUMENTS

| | | | |
|---|---|---|---|
| WO | 2011075798 | A1 | 6/2011 |
| WO | 2015028908 | A1 | 3/2015 |
| WO | 2015091539 | A1 | 6/2015 |

* cited by examiner

Fig.2
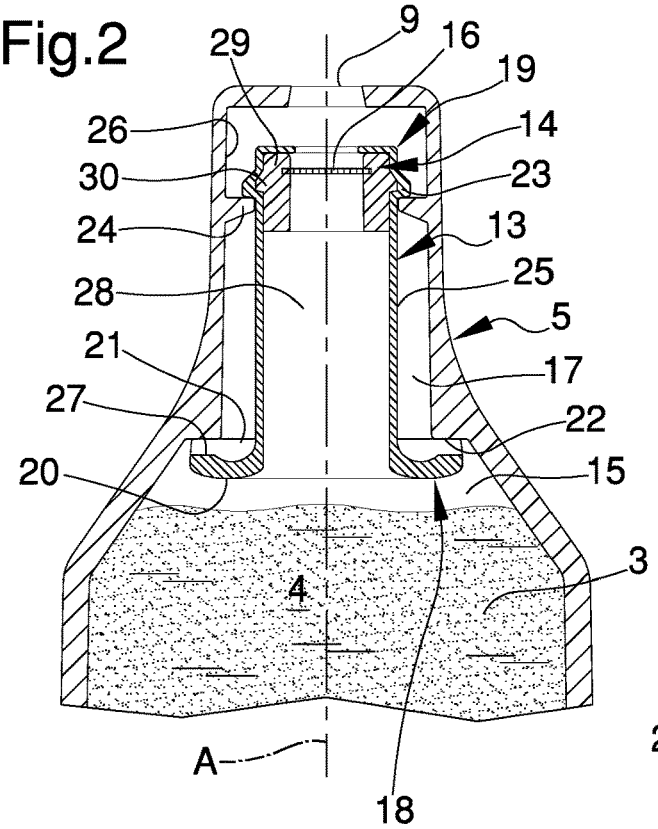
Fig.3
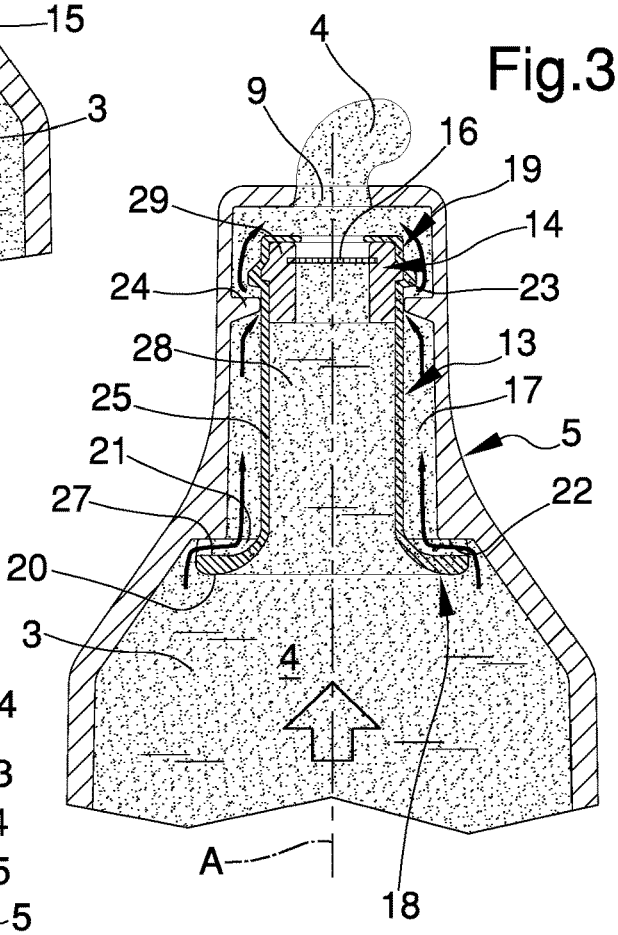
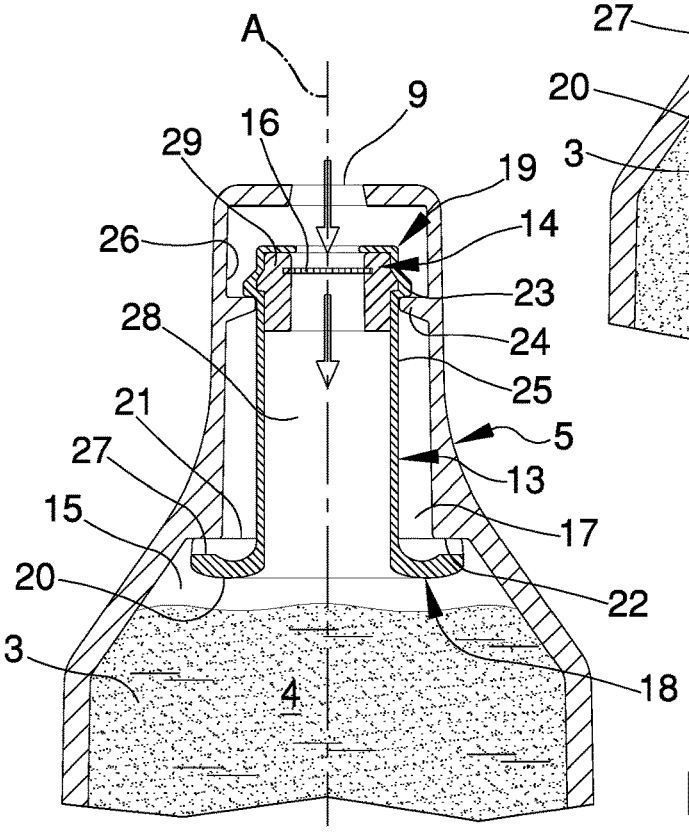
Fig.4

CONTAINER, PARTICULARLY FOR MEDICAL PRODUCTS, PHARMACEUTICALS, COSMETICS, FOOD OR THE LIKE

TECHNICAL FIELD

The present invention relates to a container, particularly for medical products, pharmaceuticals, cosmetics, food or the like.

BACKGROUND ART

With particular reference to pharmaceutical and/or cosmetic industries, the use is well known of containers made of polymeric material for the packaging of one or more doses of fluid, liquid or pasty products.

Out of the various types of available container, a particular category is represented by bottles commercially known as "preservative-free", which are widely used, for example, in the packaging of ophthalmic products.

In particular, a preservative-free container is meant a bottle, generally not disposable, adapted to contain fluid products free of preservatives, in order to protect them from bacterial contamination for a certain period of time during which the product can be used.

In fact, when the pharmaceutical and/or cosmetic products undergo microbiological contamination they are no longer suitable for use, as they could cause infections, irritations and other disorders.

In many cases, the fluid products are added with preservatives of natural or synthetic origin that guarantee the preservation thereof for a more or less extended period of time, which is usually about thirty days after the opening of the sealed bottle.

These substances can however lead to the onset of allergies or intolerances, so the production and commercial trend is towards products that are substantially free of preservatives, which are then packaged in specially designed preservative-free containers.

From the construction point of view, the preservative-free containers are made by assembling different components, after filling the bottle with the fluid product.

The sterile fluid product is placed in a bottle which is also sterile, obtained by means of injection molding of molten polymer, in an inert atmosphere so as to preserve the non-contamination thereof.

The bottle is then hermetically sealed by means of a special sealed dispenser and covered with a cap that allows protecting the dispenser from dust.

In particular, the container as a whole is sterile until the first opening thereof, after which the dispenser effectively guarantees the preservation of the fluid product for a certain period of time, protecting it from microbial contamination.

A particular type of dispenser is shown in the U.S. Pat. No. 9,833,356, which shows a dispenser for the delivery of a pharmaceutical liquid provided with a tank of liquid placed inside a housing and an outlet opening through which the liquid is discharged into the surrounding atmosphere.

This dispenser is provided with an outlet valve, which can be opened in a pressure-dependent manner or manually operated, to allow or not the delivery of liquid.

This dispenser is designed so as to make antibacterial the surfaces intended to come into contact with the liquid, thus ensuring the usability of the liquid for a period of time after opening the container for its first use.

These containers do however have some drawbacks.

In fact, the containers of known type require a rather long and complex packaging process, which involves several steps of filling the bottle and assembling the various components with a consequent increase in production costs which, inevitably, affect the retail price, with the risk of making the products less attractive to customers.

Moreover, the dispensers with which this particular category of containers is provided have a rather complex structure and their cost is high, which leads to a further increase in production costs and the related retail prices.

Furthermore, the aforementioned containers, precisely because they are made by means of assembly, may not be hermetically isolated from the outside, with the consequent risk of microbial contamination of the fluid product contained therein.

Known containers are also generally characterized by a not negligible size, so they are packaged individually and require a bulky and impractical packaging.

DESCRIPTION OF THE INVENTION

The main aim of the present invention is to devise a container, particularly for medical products, pharmaceuticals, cosmetics, food or the like, that allows protecting the fluid product from microbial contamination for a certain period of time after the first use, so as to ensure the re-use thereof.

Within the illustrated aim, one object of the present invention is to allow obtaining a container that allows ensuring the sterility of the packaged fluid product until the first opening of the bottle.

Another object of the present invention is to allow the reduction of production costs and, consequently, the retail price.

Yet another object of the present invention is to obtain a container with a small size that can be packaged using a simpler and cheaper packaging than the known types of packaging.

Another object of the present invention is to devise a container that allows overcoming the mentioned drawbacks of the prior art within a simple, rational, easy, effective to use and low cost solution.

The aforementioned objects are achieved by the present container, particularly for medical products, pharmaceuticals, cosmetics, food or the like, according to claim 1.

BRIEF DESCRIPTION OF THE DRAWINGS

Other characteristics and advantages of the present invention will be more evident from the description of a preferred, but not exclusive, embodiment of a container, particularly for medical products, pharmaceuticals, cosmetics, food or the like, illustrated by way of an indicative, but not limited example, in the attached tables of drawings wherein:

FIG. 2 is a sectional view of a detail of one of the containers of FIG. 1 with the dispensing valve in a closure configuration;

FIG. 3 is a sectional view of the detail of FIG. 2 with the dispensing valve in an opening configuration;

FIG. 4 is a sectional view of the detail of FIG. 2 with the dispensing valve in a closure configuration and the return valve crossed by air;

EMBODIMENTS OF THE INVENTION

Figure 1:
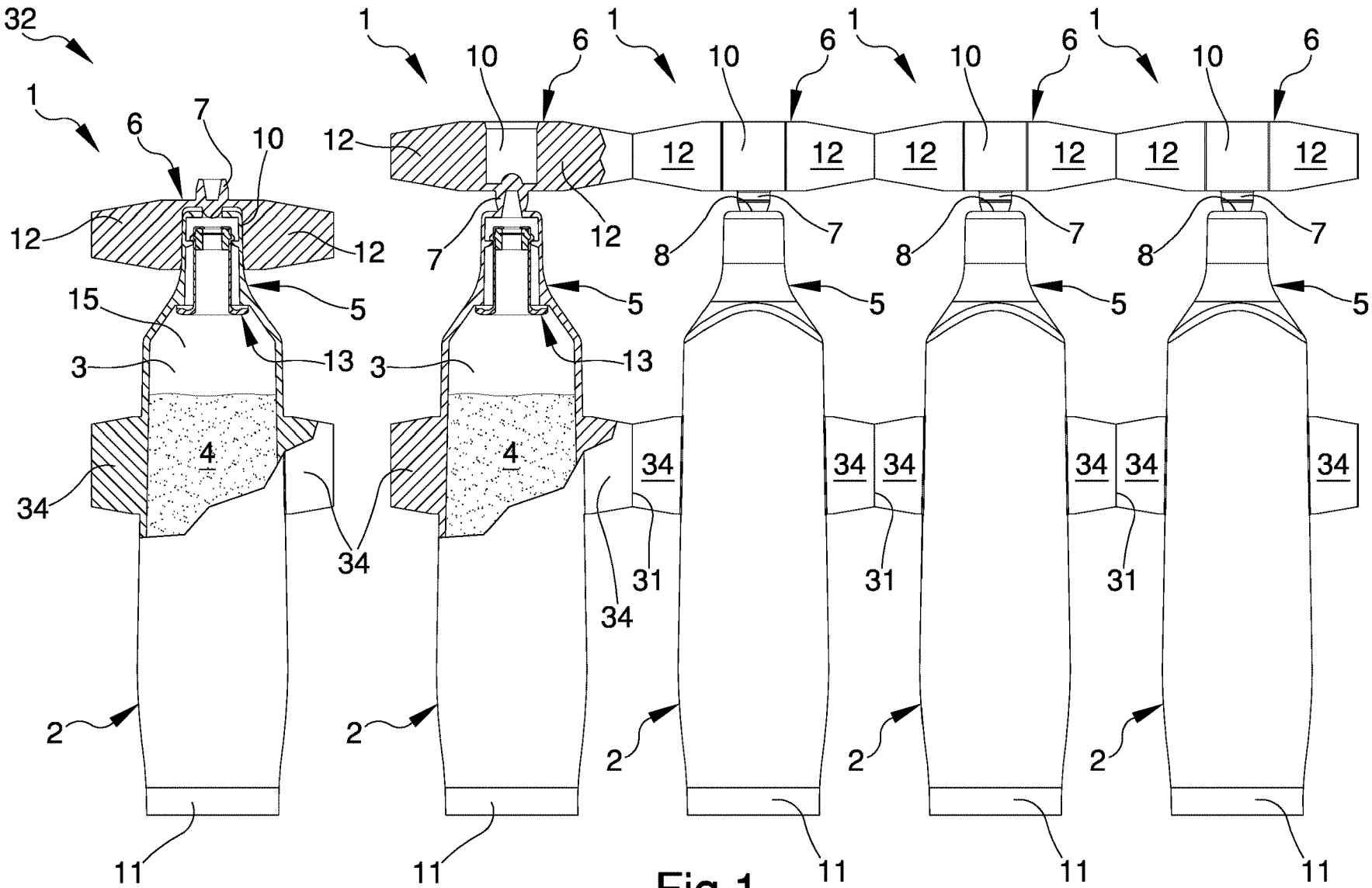
FIG. 1 is a partially sectional front view of a first embodiment of a strip of containers according to the invention.

With particular reference to these illustrations, reference numeral 1 globally indicates a container, particularly for medical products, pharmaceuticals, cosmetics, food or the like.

The container 1, particularly for medical products, pharmaceuticals, cosmetics, food or the like, comprises at least one at least partly compressible hollow body 2 defining at least one chamber 3 for containing at least one fluid product 4 and provided with at least one neck 5.

It should be specified that within this discussion the term "fluid product" does not only refer to liquid products, but also to viscous products, e.g. in the form of pastes and gels, and powdery products, in particular very fine powders with great smoothness.

In the embodiments of the container 1 shown in the illustrations, the hollow body 2 extends in a substantially longitudinal direction, but different types of conformation cannot be ruled out.

In addition, the container 1 comprises at least one closure element 6 made in a single body piece with the hollow body 2 and provided with at least one attachment portion 7 which, in a packaging configuration, is associated with the hollow body 2 along at least one predefined breaking line 8 adapted to allow the separation of the closure element 6 from the hollow body 2 in a configuration of separation in which on the hollow body 2 is formed at least one dispensing opening 9 of the fluid product 4.

In the ambit of the present discussion, the term "predefined breaking line" means an area of the container 1 which has a thinned and weakened section and which is therefore, easily tearable.

In the preferred embodiment shown in FIGS. 1 to 5, the closure element 6 comprises at least one re-closure portion 10 joined to the attachment portion 7 and positionable to re-close the dispensing opening 9.

Usefully, the re-closure portion 10 has a substantially cap shape and comprises at least one lateral wall and at least one bottom wall, in which the lateral wall can be fitted on the neck 5 in a re-closure configuration.

Usefully, the fact of providing the re-closure portion 10 having a cap shape and which can be fitted on the neck 5 allows re-closing the container 1 and storing the fluid product for uses after the first one, preventing dust and dirt from settling near the dispensing opening 9.

The hollow body 2 and the closure element 6 are preferably made in a single body piece by means of a plastic injection molding process inside a specially shaped mould.

In the preferred embodiment shown in the figures, the dispensing opening 9 has a substantially circular shape, but solutions cannot be ruled out that provide for different types of conformation.

Usefully, the hollow body 2 has a substantially tubular shape and comprises at least one introduction opening formed in a substantially opposite position from the predefined breaking line 8 and adapted to insert the fluid product 4 inside the chamber 3, in a filling configuration.

The filling of the chamber 3 is carried out with the closure element 6 which is still joined to the hollow body 2, so that the fluid product 4 does not flow out.

In addition, the introduction opening can be closed once the filling has been completed, so as not to make the fluid product 4 flow out and to allow the container 1 to be easily packaged.

Usefully, the introduction opening comprises at least one edge and is adapted to be sealed, after filling, by pressing the edge itself to define at least one sealed portion 11.

The sealed portion 11 may also be made substantially plate-shaped so as to write on this portion the data relating to the fluid product 4 contained in the container 1, such as e.g. name, composition, best before date, etc.

The possibility cannot be ruled out of closing the introduction opening through a means other than sealing, such as a cap that can be inserted into the introduction opening itself.

The closure element 6 is usefully provided with at least one gripping portion 12 which is adapted to be gripped to allow the separation of the closure element itself from the hollow body 2.

The closure element 6 is provided e.g. with a pair of substantially plate-shaped gripping portions 12 and associated laterally to the closure element itself in order to allow an easier grip and to lever with respect to the hollow body 2 more easily, separating the closing element 6 therefrom.

The possibility cannot however be ruled out to make the gripping portion 12 with a different conformation, e.g. provided with gripping fins, at least with partly cylindrical shape, etc.

According to the invention, the container 1 comprises at least one dispensing valve 13 adapted to allow the outflow of the fluid product 4 through the dispensing opening 9 and at least one return valve 14 adapted to allow the one-way flow of air 15 towards the chamber 3, wherein the return valve itself comprises filtering means 16 adapted to filter the air 15 entering the chamber 3.

In other words, the dispensing valve 13 allows delivering the fluid product 4 only when established by the user, thus avoiding accidental outflow due to, e.g., the overturning of the container 1.

In addition, the presence of the filtering means 16 cause the air 15 entering the chamber 3 from the outside through the return valve 14 to be substantially clean.

The air 15, in fact, contains countless suspended particles, such as e.g. dust, pollen, but also microorganisms, such as bacteria, yeasts and molds.

In particular, when microorganisms come into contact with the fluid product 4 they tend to proliferate, thus polluting the fluid product itself, which cannot be reused as it might cause infections to the user.

As a result, the filtering means 16 allow retaining dust and microorganisms present in the air 15, so as not to risk contamination of the fluid product 4 after its first use, thus allowing it to be stored for a certain period of time.

In the embodiment shown in FIGS. 1 to 5, the filtering means 16 are composed of a filtering disc through which the air 15 passes one-way from the outside to the inside which are preferably made of porous material, such as e.g. cellulose, with pore size comparable with the average size of the suspended solids or microorganisms, which then remain trapped on the filter.

It is important that the filtering means 16 are made of a material that does not interact with the fluid product 4 contained in the chamber 3 and with which they may come into contact, so as not to alter the characteristics thereof.

Usefully, the fact of providing the dispensing valve 13 and the return valve 14 allows making the container 1 "preservative-free", i.e. a container that allows storing a drug or a cosmetic for a certain period of time, typically thirty days, after the first opening of the bottle without the use of preservatives and without it being altered or contaminated.

Numerous studies have in fact highlighted the sensitizing effect on the body due to the use of preservatives, which can lead to irritation, allergies and possible long-term effects.

Consequently, the fact that the container 1 falls into the category commercially known as "preservative-free" allows making the invention more attractive even to users with special needs.

Usefully, the dispensing valve 13 and the return valve 14 are housed in at least one dispensing channel 17 formed in the neck 5 and communicating with the chamber 3 and with the dispensing opening 9, although the possibility cannot be ruled out of placing these in a different part of the hollow body 2.

Specifically, the dispensing valve 13 is arranged in the proximity of the dispensing opening 9, so as to allow the delivery of the fluid product 4.

Advantageously, the dispensing valve 13 is moveable along at least one longitudinal axis A of the dispensing channel 17 between at least one closure configuration in which the dispensing valve 13 is arranged so as to prevent the flow of the fluid product 4 through the dispensing channel 17 and at least one opening configuration in which the dispensing valve 13 is displaced along the longitudinal axis A to allow the flow of the fluid product 4 through the dispensing channel 17.

In the preferred embodiment shown in FIGS. 1 to 5, the movement of the dispensing valve 13 from the closure configuration to the opening configuration takes place by increasing the pressure inside the chamber 3.

Usefully, the dispensing valve 13 is normally in the closure configuration, in order to prevent the accidental delivery of the fluid product 4 and to avoid the unwanted entry of unfiltered air 15 inside the chamber 3.

Usefully, the hollow body 2 is pressable to allow the reduction in volume of the chamber 3 for the dispensing of the fluid product 4.

In other words, by pressing the hollow body 2 between the fingers, the user causes a reduction in volume of the chamber 3, with a consequent increase in the pressure inside it, which exerts a force on the dispensing valve 13 along the longitudinal axis A, thus causing it to move from the closure configuration to the opening configuration.

The dispensing valve 13 usefully comprises at least one base portion 18 housed inside the chamber 3 and at least one top portion 19 opposite the base portion 18.

The base portion 18 is provided with a thrust surface 20, which allows having a sufficiently large surface on which the pressure acts and, as a result, to obtain a sufficient thrust to the movement of the dispensing valve itself.

In addition, the base portion 18 is provided with at least one base protrusion 21 substantially annular that surrounds the perimeter of the base portion 18 and is adapted to abut against at least one respective abutment surface 22 obtained at the base of the dispensing channel 17.

Advantageously, the dispensing valve 13 comprises at least a first substantially annular protrusion 23 projecting from at least one external surface 25 of the dispensing valve 13 and adapted to abut in the closure configuration against at least one respective second substantially annular protrusion 24 formed on at least one internal surface 26 of the dispensing channel 17.

Preferably, the first protrusion 23 is obtained at the top portion 19, although the possibility of obtaining the first protrusion 23 in a different position cannot be ruled out.

In addition, the dispensing valve 13 is usefully made of an elastically deformable material, such as rubber, and, before filling the chamber 3 with the fluid product 4, it is assembled inside the dispensing channel 17 pushing it along the longitudinal axis A.

Since it is made of rubber or other elastically deformable material and since it has a considerable elasticity, during assembly the top portion 19 deforms at least in part so as to allow the first protrusion 23 passing beyond the second protrusion 24 and prevent any disassembly of the dispensing valve 13 during use.

The base portion 18 is also provided with at least one gap 27 obtained at the base protrusion 21, which gap is adapted to allow the passage of the fluid product 4 inside the dispensing channel 17.

Figure 6:
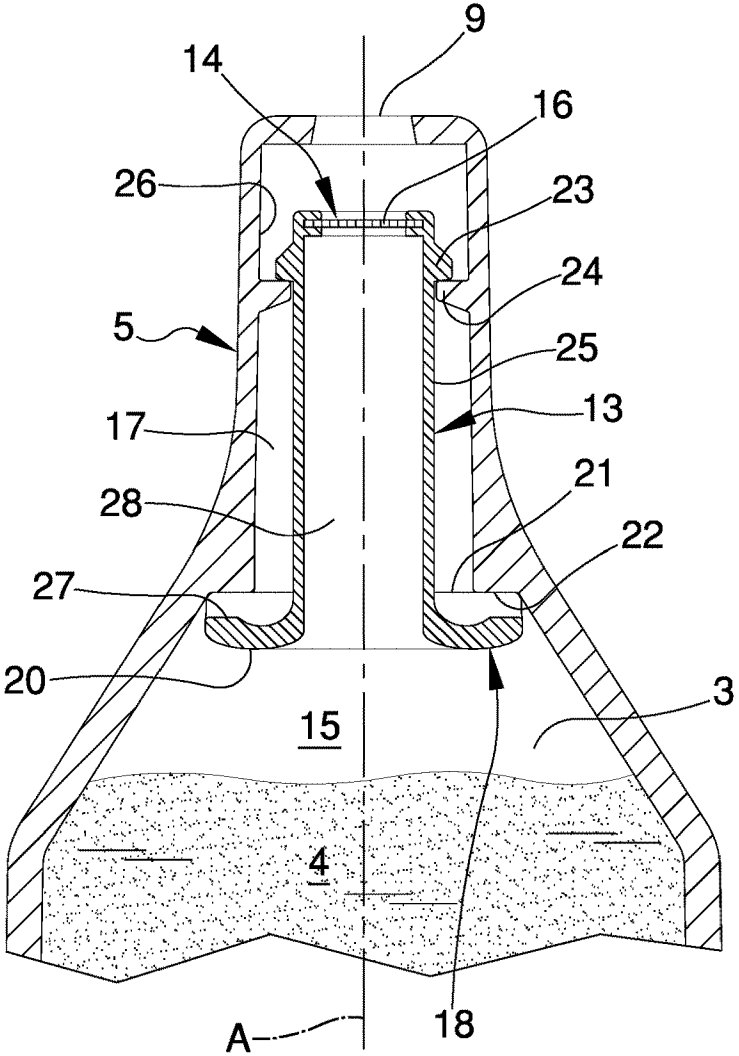
FIG. 6 is a sectional view of a detail of a second embodiment of the container according to the invention.
Figure 5:
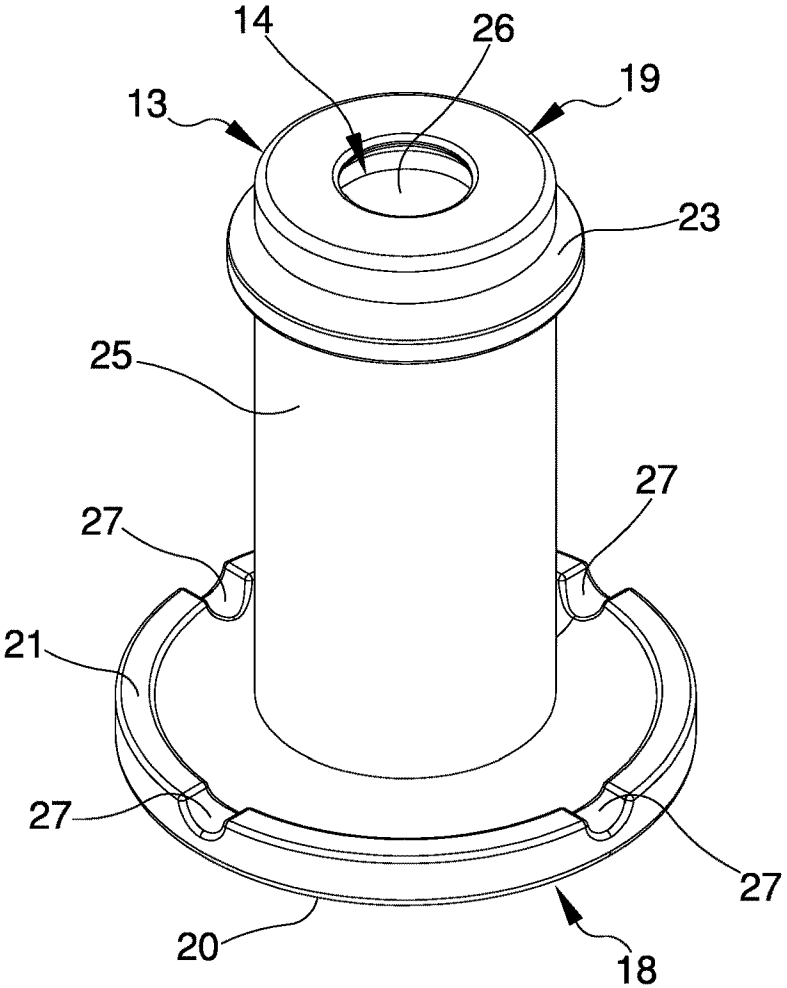
FIG. 5 is an axonometric view of the valve assembly of the containers of FIG. 1.

As shown in FIG. 6, the base portion 18 is provided with a plurality of gaps 27, thus obtaining a homogeneous outflow of the fluid product 4.

Usefully, the thrust that the pressure increase inside the chamber 3 gives on the thrust surface 20 causes a partial deformation of the dispensing valve 13, schematically shown in the relevant figures, as the valve is compressively pushed by the pressure increase, but the base protrusion 21 is in abutment and this leads to deformation.

The dispensing valve 13, in fact, thanks to the high elasticity of the material from which it is made, undergoes a deformation at the base portion 18, stretching along the longitudinal axis A, with the consequent removal of the first protrusion 23 away from the second protrusion 24 and the passage to the opening configuration, as shown in FIG. 3.

In this configuration, a path is defined between the dispensing channel 17 and the dispensing valve 13 which allows the passage of the fluid product 4 as far as the dispensing opening 9, as schematically shown in the same FIG. 3.

The fact of providing the dispensing valve 13 made of rubber, or in any case of a material with high elasticity, allows this valve to be moved between the two described configurations without the need to provide elastic means such as springs or the like, with a consequent reduction in the construction complexity and the relevant cost.

When the hollow body 2 is pressed by the user in order to deliver the fluid product 4, the fluid product 4 leaves the container 1 together with part of the air 15 contained therein, so that in chamber 3 a depression is created that causes the hollow body 2 to remain pressed.

However, in the event of the hollow body 2 remaining pressed, it is no longer possible to deliver the fluid product 4 because the user is no longer able to vary the volume of the chamber 3 and the pressure inside it by pressing the hollow body itself.

Therefore, the return valve 14 usefully allows restoring the normal pressure inside the chamber 3 through the entry of air 15 inside the chamber itself, restoring the volume of air 15 and of the fluid product 4 that have flown out, thus allowing the hollow body 2 to come back to its normal compressible configuration.

Advantageously, the return valve 14 is integrated in the dispensing valve 13 to form a valve assembly 13, 14 arranged inside the dispensing channel 17 in the proximity of the dispensing opening 9.

The fact of providing for a single valve assembly 13, 14 allows considerably speeding up the manufacturing operations of container 1 with consequent reduction in the production costs.

The possibility cannot however be ruled out of providing the dispensing valve 13 and the return valve 14 separated from each other and housed in an independent manner inside the container 1.

The dispensing valve 13 comprises at least one internal through duct 28 adapted to allow the entry of air 15 into the chamber 3 and in which the return valve 14 is housed.

In the particular embodiment shown in FIGS. 2 to 4, the return valve 14 comprises at least one support 29 which can be inserted in an immoveable manner in the internal duct 28 and with such a support 29 are associated the filtering means 16 of the air 15 entering the chamber 3.

Preferably, the support 29 comprises inside the same the filtering disc at least partly embedded in the material from which the support itself is made.

The support 29 comprises at least one external surface 25 on which are made the interlocking means 30 adapted to allow the assembly by interlocking of the support itself inside the internal duct 28.

Preferably, the interlocking means 30 are made cantilevered from the lateral surface of the support 29 and are adapted to interlock inside corresponding seats formed inside the internal duct 28.

In addition, the support 29 is substantially housed at the top portion 19, although the possibility cannot be ruled out of housing the support itself in a different position inside the internal duct 28.

Advantageously, the container 1 comprises at least one breakable attachment area 31 adapted to connect the container itself to at least one adjacent container 1 to form a strip 32 of containers 1.

In this regard, it is specified that a strip consists of a set of containers locked together and joined along special weakened section, easily tearable connecting lines.

In the embodiment shown in FIGS. 1 to 5, the container 1 is provided with at least one spacer element 33, preferably substantially plate-shaped, and associated along the breakable attachment area 31 with the spacer element 33 of the adjacent container 1 to form a strip 32 of containers 1.

Preferably, the hollow body 2 is provided with a pair of spacer elements 33 each made on diametrically opposite lateral portions of the hollow body 2.

In addition, as shown in the figures, the closure element 6 is associated with the closure element 6 of the adjacent container 1 at another breakable attachment area 31.

The possibility cannot however be ruled out of making a strip of containers 1 associated with each other in a different way from the one shown above.

The strip 32 of containers 1 comprises a plurality of containers 1, having the characteristics shown above, associated with each other at at least one breakable attachment area 31.

As can be seen, it is possible to provide a plurality of breakable attachment areas 31 between the containers 1 forming the strip 32, which areas can be easily broken in order to separate the container itself from the strip 32.

A second embodiment of the container 1 is shown in FIG. 6.

This embodiment is completely similar to the previous one, except for the fact that the return valve 14 comprises the filtering means 16 housed in an immoveable manner in the internal duct 28 for the filtration of the air 15 entering the chamber 3.

In this particular case, the filtering disc is at least partly embedded in the rubber, or in another elastic deformable material, from which the dispensing valve 13 is made already during the molding phase of the piece, positioning it substantially at the top portion 19.

The operation of the container 1 in FIG. 6 is similar to that of the embodiment shown in FIGS. 1 to 5.

Figure 7:
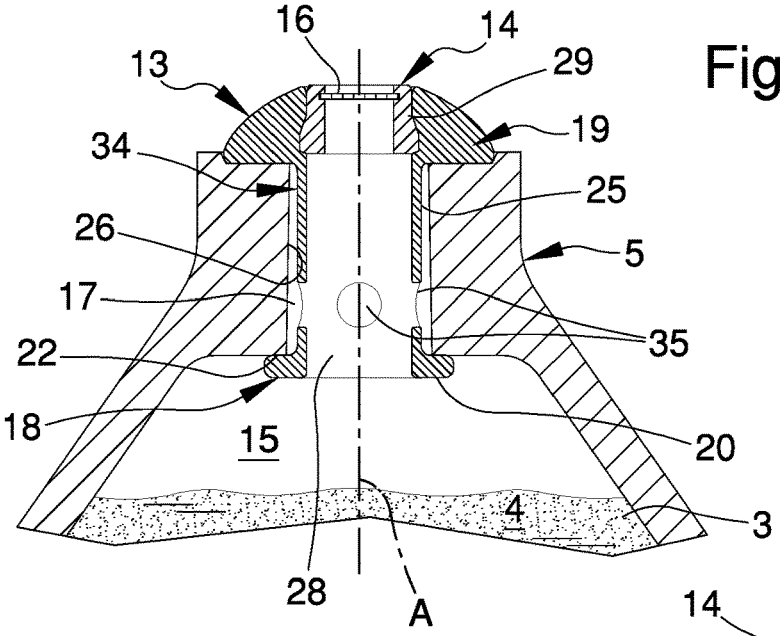
FIG. 7 is a sectional view of a detail of a third embodiment of the container with the dispensing valve in a closure configuration.
Figure 8:
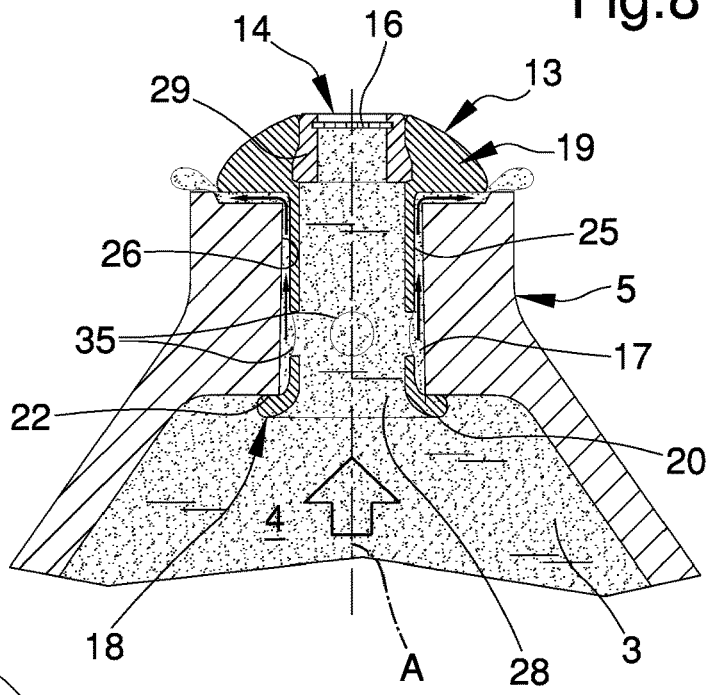
FIG. 8 is a sectional view of the detail of FIG. 7 with the dispensing valve in an opening configuration.
Figure 9:
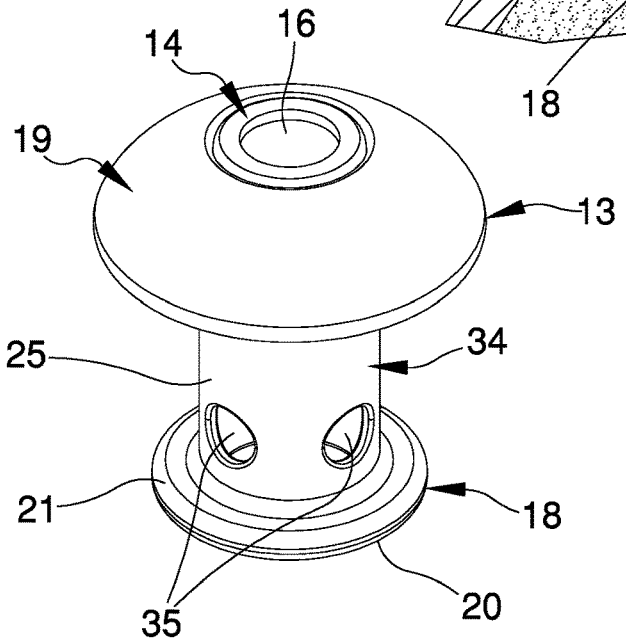
FIG. 9 is an axonometric view of the valve assembly of the container of FIG. 7.

A third embodiment of the container 1 is shown in FIGS. 7 to 9.

In particular, in this embodiment, the base portion 18 is free of gaps 27, so the base protrusion 21 entirely adheres to the abutment surface 22.

The dispensing valve comprises a lateral portion 34 placed between the base portion 18 and the top portion 19 and provided with at least one hole 35 that allows the outflow of the fluid product 4 from the chamber 3 to the outside.

Usefully, the lateral portion 34 comprises a plurality of holes 35 that allow for a homogeneous and optimal outflow of the fluid product 4.

In addition, the top portion 19 has an at least partly hemispherical conformation and is significantly larger than that shown in the first embodiment.

As shown in FIGS. 7 and 8, the top portion 19 of the dispensing valve 13 is housed outside of the dispensing opening 9, in a seat specifically created at the dispensing opening itself.

Similarly to the embodiment shown in FIGS. 1 to 5, the filtering means 16 comprise at least one filtering disc associated with a corresponding support 29 housed inside the dispensing channel 17.

The operation of the container 1 is similar to that described for the solution shown in FIGS. 1 to 5.

In particular, the passage of the fluid product 4 towards the outside gives a force on the first protrusion 23 which, being made of flexible material, deforms to allow the passage of the fluid product itself.

Figure 10:
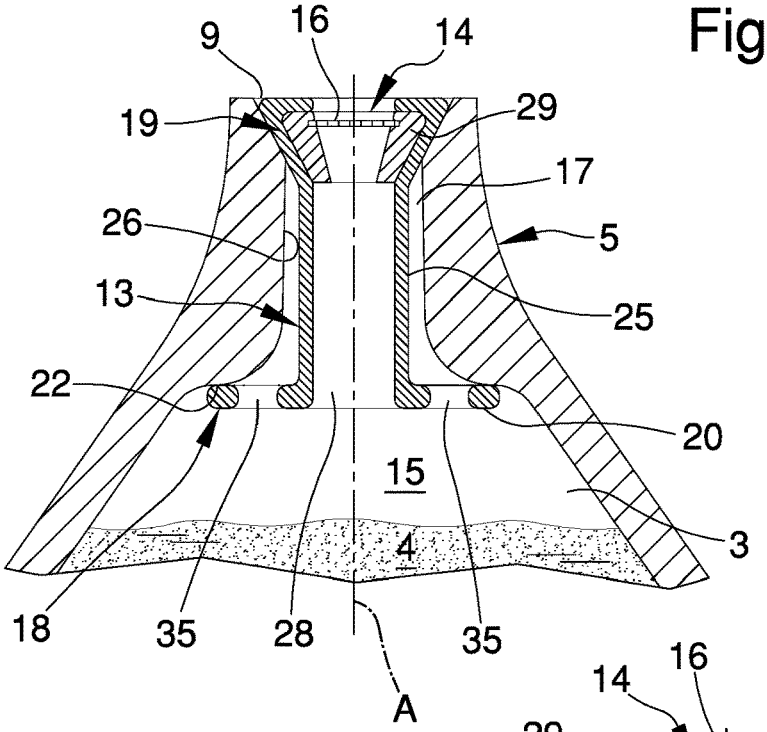
FIG. 10 is a sectional view of a detail of a fourth embodiment of the container with the dispensing valve in a closure configuration.
Figure 11:
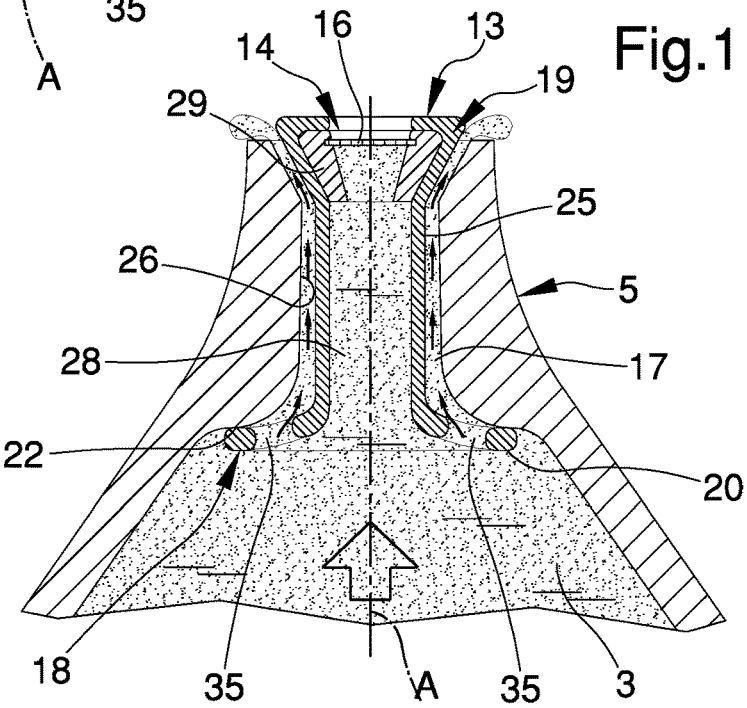
FIG. 11 is a sectional view of the detail of FIG. 10 with the dispensing valve in an opening configuration.
Figure 12:
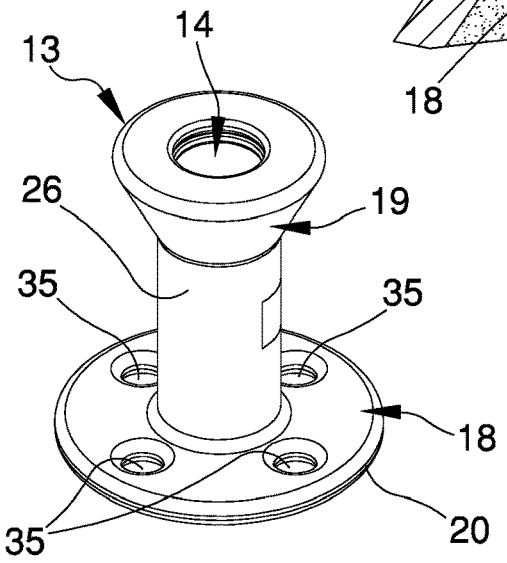
FIG. 12 is an axonometric view of the valve assembly of the container of FIG. 10.

A fourth embodiment of the container 1 is shown in FIGS. 10 to 12.

In this embodiment of the container 1, the holes 35 are obtained on the base portion 18, so as to allow the passage of the fluid product 4.

The operation of the container 1 in the fourth embodiment is substantially similar to that described for the first embodiment.

In addition, the top portion 19 has a substantially truncated-cone shape, which in the closure configuration is arranged in abutment on the internal surface 26, having a shape substantially complementary to the top portion itself.

In this way, the movement along the longitudinal axis A of the dispensing valve 13 leads to the displacement of the top portion 19 from the internal wall 26, with consequent outflow of the fluid product 4.

Similarly to the embodiment shown in FIGS. 1 to 5, the filtering means 16 comprise at least one filtering disc associated with a relevant support 29 housed inside the dispensing channel 17.

Figure 13:
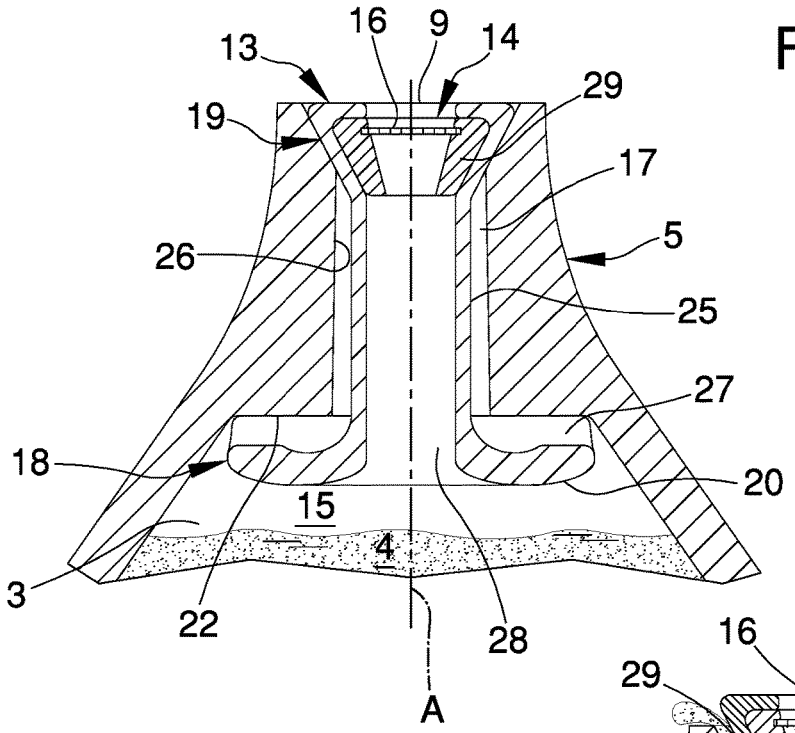
FIG. 13 is a sectional view of a detail of a fifth embodiment of the container with the dispensing valve in a closure configuration.
Figure 14:
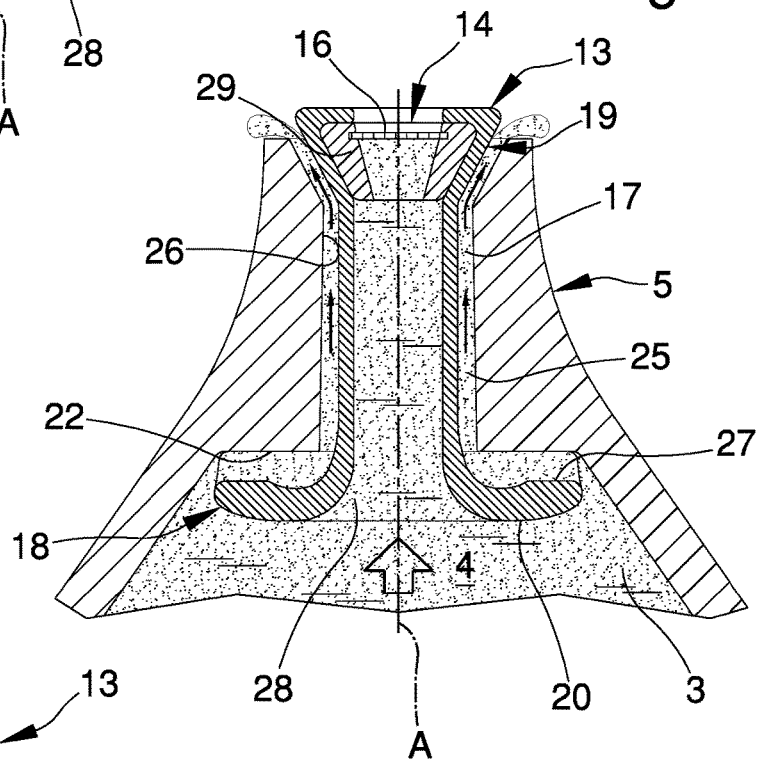
FIG. 14 is a sectional view of the detail of FIG. 13 with the dispensing valve in an opening configuration.
Figure 15:
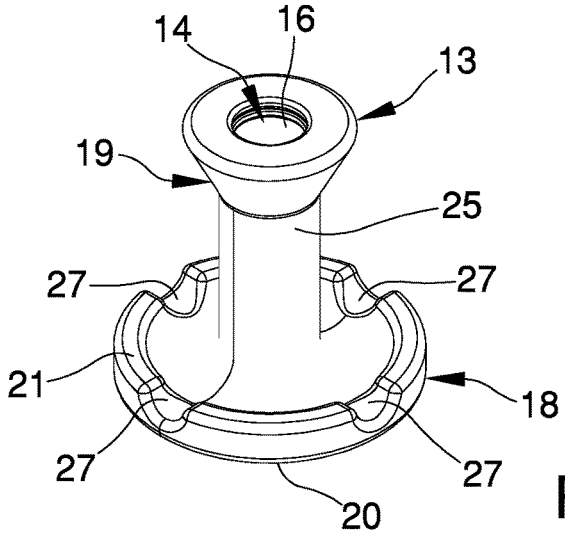
FIG. 15 is an axonometric view of the valve assembly of the container of FIG. 13.

A fifth embodiment of the container 1 is shown in FIGS. 13 to 15.

This embodiment comprises a dispensing valve 13 similar to that shown in FIGS. 9 to 12, except for the fact that the base portion 18 is without holes 35, but it is provided with gaps 27, similarly to what is shown in FIGS. 1 to 5.

The operation of the container 1 of FIGS. 13 to 15 is similar to that described for the embodiment of FIGS. 1 to 5.

Figure 16:
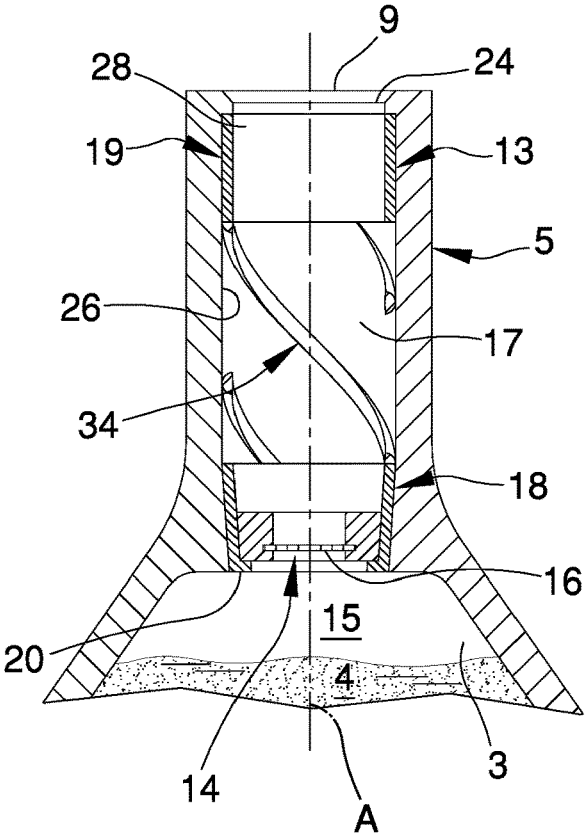
FIG. 16 is a sectional view of a detail of a sixth embodiment of the container with the dispensing valve in a closure configuration.
Figure 17:
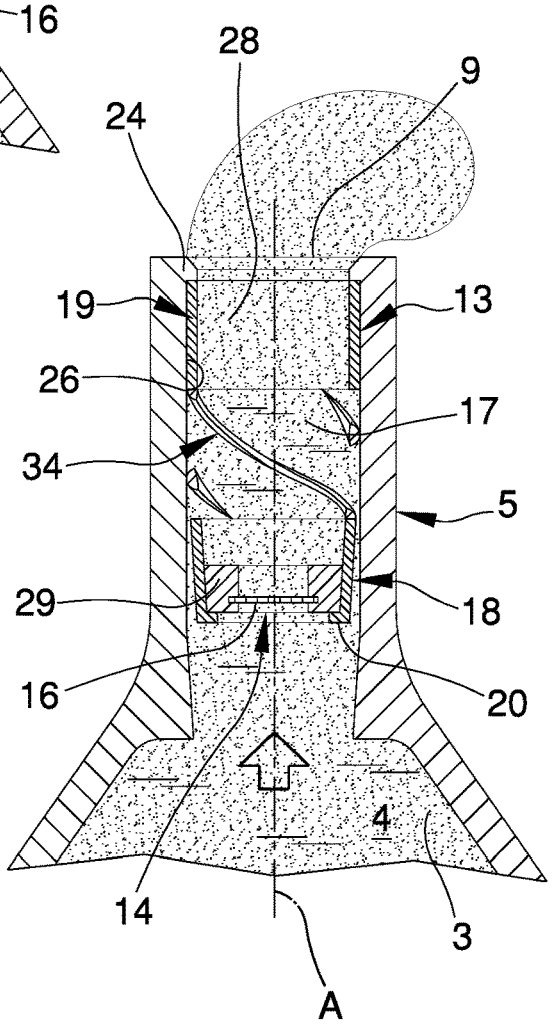
FIG. 17 is a sectional view of the detail of FIG. 16 with the dispensing valve in an opening configuration.
Figure 18:
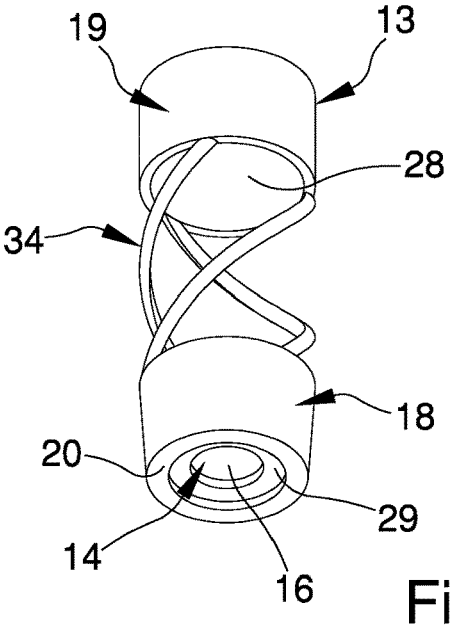
FIG. 18 is an axonometric view of the valve assembly of the container of FIG. 16.

A sixth embodiment of the container 1 is shown in FIGS. 16 to 18.

Advantageously, the dispensing valve 13 comprises at least a first annular portion 18 located on the side of chamber 3 and at least a second annular portion 19 opposed the first annular portion 18 and located on the side of the dispensing opening 9, which are joined together by at least one helical portion 34.

In particular, the first annular portion 18 is closed by the return valve 14, which is housed in the relevant internal duct 28, while the second annular portion 19 is open and is adapted to abut against the second protrusion 24.

Usefully, as can be seen from the relevant figures, the return valve 14 comprises a relevant support 29 housed in the first annular portion 18 and inside which are housed the filtering means 16, consisting of at least one filtering disc.

Moreover, the portion of the dispensing channel 17 closest to the entrance of chamber 3 has a substantially flared shape and the first annular portion 18 housed therein has a complementary shape, so that in the closure configuration the first annular portion itself seals, thus preventing the accidental outflow of the fluid product 4.

From an operational point of view, the increase in pressure inside the chamber 3 gives a thrust to the first annular portion 18, which undergoes a translation along the longitudinal direction A.

Since the second annular portion 19 abuts against the second protrusion 24, the translation suffered by the first annular portion 18 causes the deformation of the helical portion 34, which behaves similarly to a spring, thus defining the opening configuration.

This movement from the closure configuration to the opening configuration allows the fluid product 4 to be dispensed, since a path is defined between the dispensing channel 17 and the first annular portion 18 through which the fluid product itself leaks, and then dispensed through the internal duct 28 of the second annular portion 19.

Figure 19:
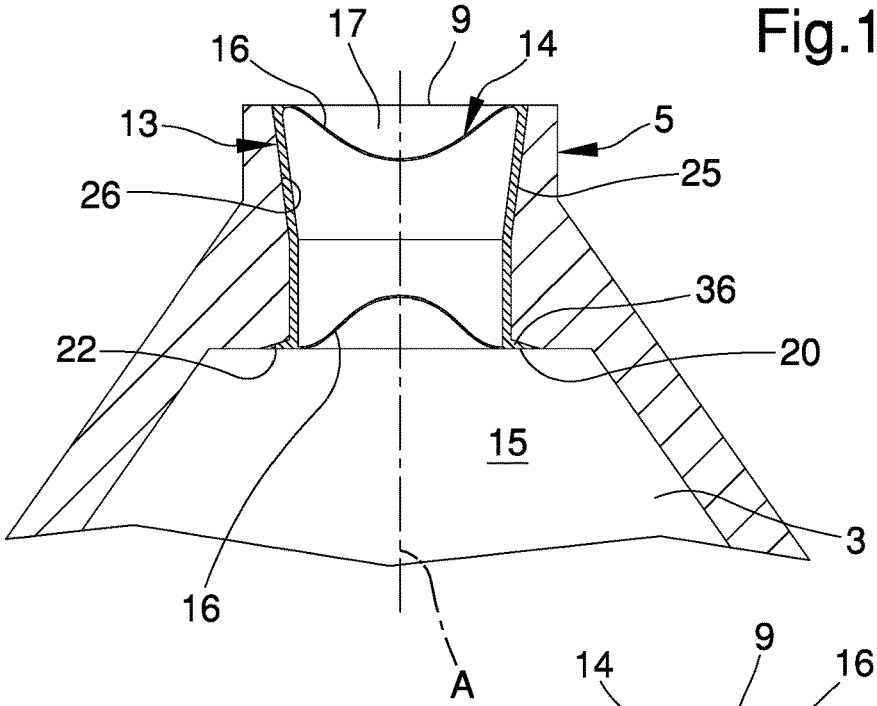
FIG. 19 is a sectional view of a detail of a seventh embodiment of the container with the dispensing valve in a closure configuration.
Figure 20:
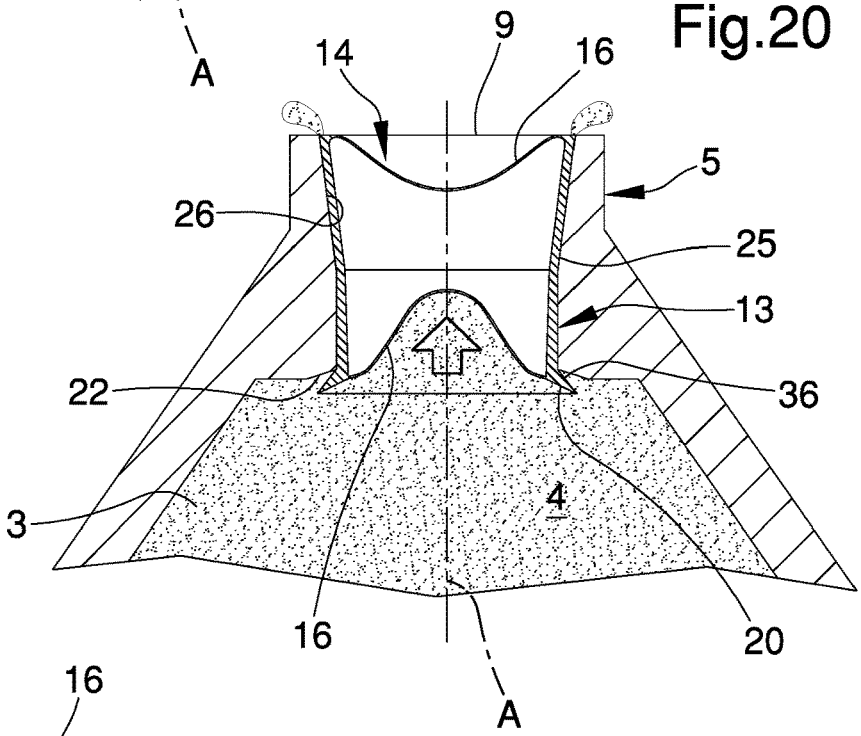
FIG. 20 is a sectional view of the detail of FIG. 19 with the dispensing valve in an opening configuration.
Figure 21:
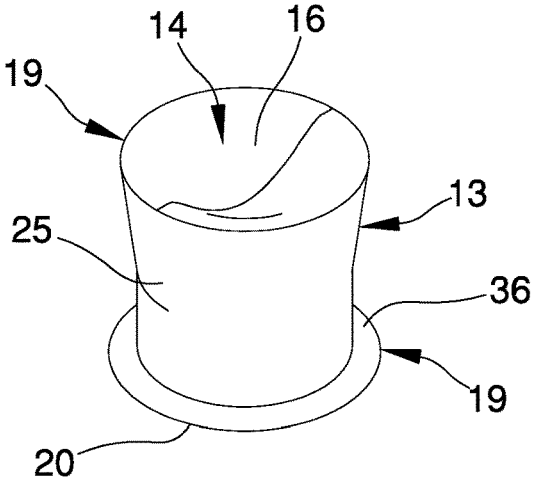
FIG. 21 is an axonometric view of the valve assembly of the container of FIG. 19.
Figure 22:
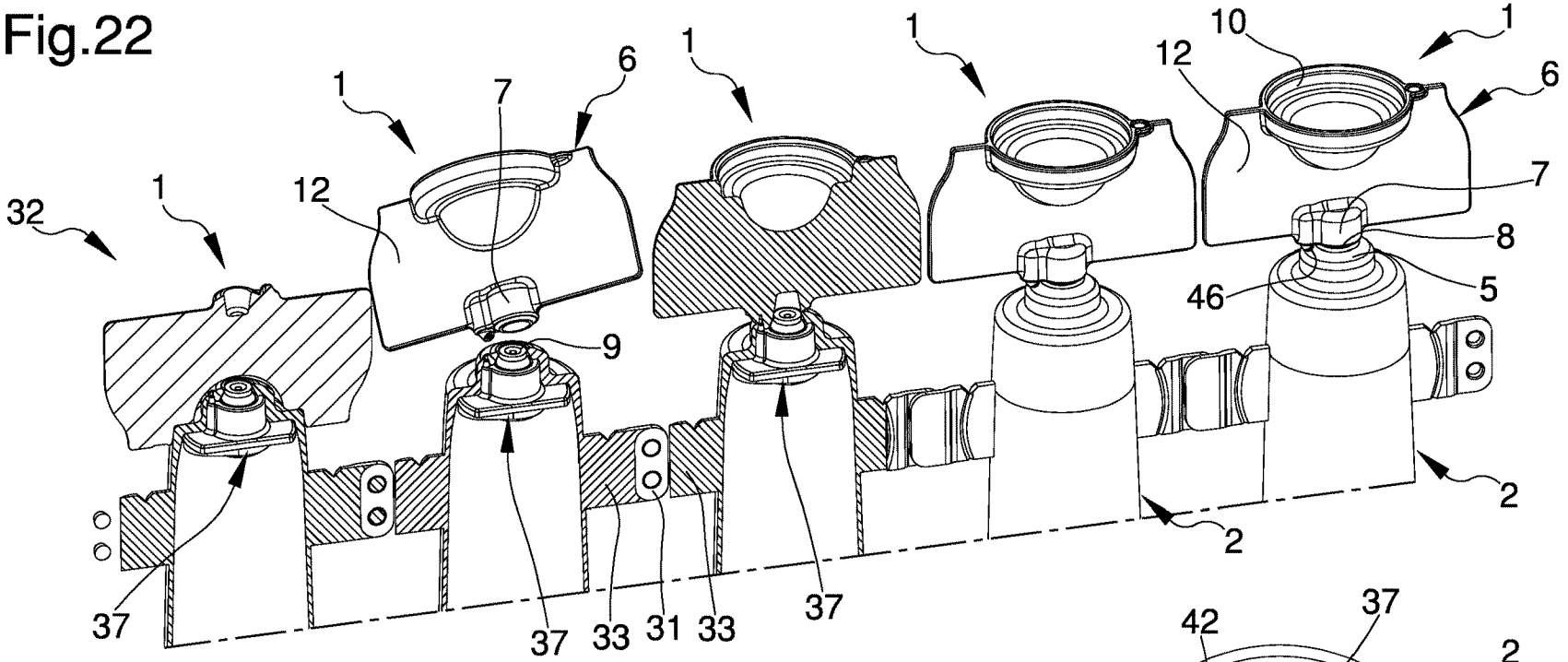
FIG. 22 is a partially sectional axonometric view of a strip of containers made in accordance with an eighth embodiment of the invention.
Figure 24:
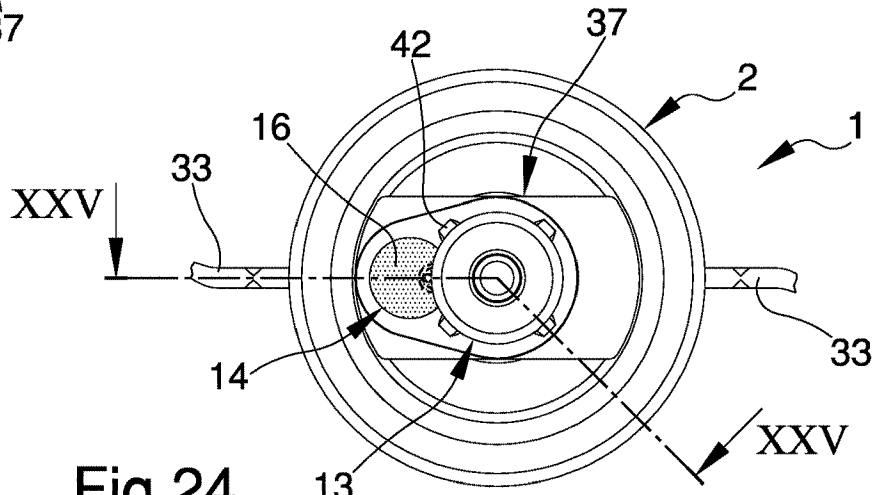
FIG. 24 is a view from below of a detail of the containers of FIG. 22.
Figure 23:
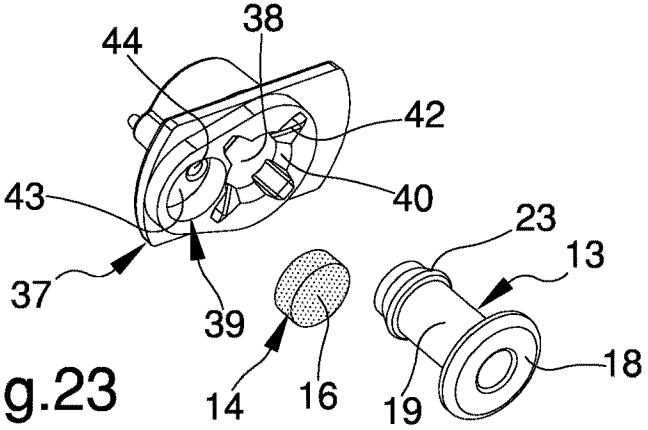
FIG. 23 is an exploded view of the valve assembly of one of the containers of FIG. 22.
Figure 25:
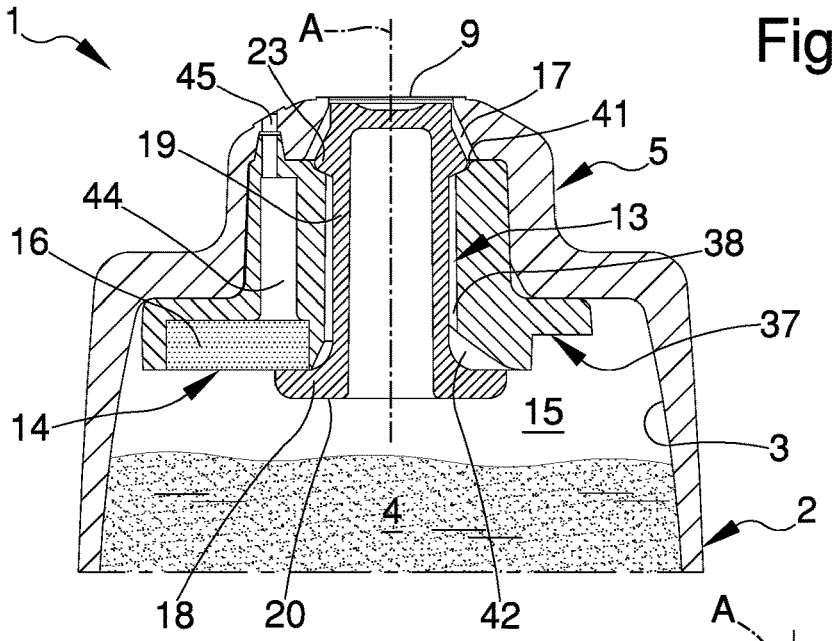
FIG. 25 is a sectional view along the plane XXV-XXV of the detail of FIG. 24, with the dispensing valve in a closure configuration.

A seventh embodiment of the container 1 is shown in FIGS. 19 to 21.

In this embodiment, the dispensing valve 13 is housed inside the dispensing channel 17 to occupy the entire volume.

In particular, the dispensing valve 13 comprises the base portion 18 with a substantially cylindrical shape and the top portion 19 with a flared shape.

In addition, the neck 5 in which the valve assembly 13, 14 is housed, is smaller than that shown in FIGS. 1 to 5.

The return valve 14 usefully comprises filtering means 16 composed of a pair of filtering membranes, each of which is immovably associated with the top portion 19 and with the base portion 18, so as to filter the air entering the chamber 3.

Preferably, the filtering means 16 are made in a single body piece with the dispensing valve 13, although the possibility of providing different types of solution cannot be ruled out.

In the present embodiment, in fact, the base portion 18 is without gaps 27 and holes 35 shown in the previous embodiments, and comprises at least one thrust portion 36 provided with a thrust surface 20 larger than the solution shown in FIGS. 1 to 5.

From a functional point of view, the thrust portion 36 in the closure configuration is attached to the abutment surface 22, so as to prevent the passage of the fluid product 4. When, on the contrary, the user presses the hollow body 2, the increase in pressure inside the chamber 3 causes a thrust to be exerted on the lower filtering membrane and on the base portion 18 in general.

This thrust causes the deformation of the filtering membrane which, being made of an at least partly elastic material, deforms by bending along the longitudinal direction A and dragging the thrust portion 36.

In the opening configuration, therefore, the thrust portion 36 tends to displace, moving away from the abutment surface 22 and leaving free the path through which the fluid product 4 leaks.

An eighth embodiment of the container 1 is shown in FIGS. 22 to 27.

Similarly to the embodiment shown in FIGS. 1 to 5, also in this case the dispensing valve 13 comprises a base portion 18, of substantially discoidal shape, and a top portion 19, which has a substantially cylindrical shape, rises from the base portion 18 and, usefully, is provided with the first protrusion 23.

Also in this case, furthermore, the filtering means 16 of the return valve 14 are composed of a filtering disc.

The return valve 14 continues to be integrated together with the dispensing valve 13 to form the valve assembly 13, 14 placed inside the dispensing channel 17 in the proximity of the dispensing opening 9; more in detail, in the embodiment of FIGS. 22 to 27 the valve assembly 13, 14 also comprises a supporting element 37 which is shaped to be fitted inside the neck 5.

The supporting element 37 can be fixed permanently inside the container 1, preferably by sealing, but other bonding systems, such as gluing and interlocking, are also possible.

The supporting element 37 is shaped so as to house both the dispensing valve 13 and the return valve 14.

In this way, the valve assembly 13, 14 is single, is manufactured separately from the hollow body 2 (by assembling the dispensing valve 13 and the return valve 14 on the supporting element 37) and, therefore, mounted inside the hollow body 2 in just one operation (i.e. the dispensing valve 13 and the return valve 14 are mounted in the hollow body 2 at the same time).

More in detail, the supporting element 37 comprises a first housing seat 38, in which the dispensing valve 13 is housed, and a second housing seat 39, in which the return valve 14 is housed.

The first housing seat 38 extends along the longitudinal axis A between an internal port 40 and an external port 41.

The internal port 40 has notches 42 and is adapted to receive in abutment the base portion 18 of the dispensing valve 13.

The external port 41, on the other hand, is adapted to receive in abutment the first protrusion 23.

The dispensing valve 13 is still made of an elastically deformable material, e.g. rubber, and can be mounted on the supporting element 37 by force-fitting it along the first housing seat 38.

Unlike what is shown in the embodiment of FIGS. 1 to 5, the top of the top portion 19 is closed and does not house the filtering means 16.

The second housing seat 39 has a recess 43 in which the filtering disc 16 can be inserted and fixed, e.g. by sealing, gluing or interlocking.

In addition, an aeration channel 44 extends from the recess 43 and is intended to connect the filtering means 16 with the outside.

Preferably, the aeration channel 44 extends parallel to the longitudinal axis A.

Once the valve assembly 13, 14 has been assembled inside the hollow body 2, the aeration channel 44 aligns with an openable section 45 of the hollow body 2.

The openable section 45, e.g., consists of a portion of the hollow body 2 which, in the packaging configuration, is associated with the closure element 6 along an additional predefined breaking line 46.

In practice, as long as the hollow body 2 and the closure element 6 are in the packaging configuration, the openable section 45 is closed and the aeration channel 44 does not communicate with the outside.

When the closure element 6 is instead separated from the hollow body 2, the openable section 45 is open and the aeration channel 44 communicates with the outside.

The operation of the embodiment shown in FIGS. 22 to 27 is as follows.

The increase in pressure which is formed inside the chamber 3 as a result of the pressing of the hollow body 2 gives a thrust to the dispensing valve 13, the top portion 19 of which undergoes a translation along the longitudinal direction A, while the base portion 18 deforms elastically.

Figure 26:
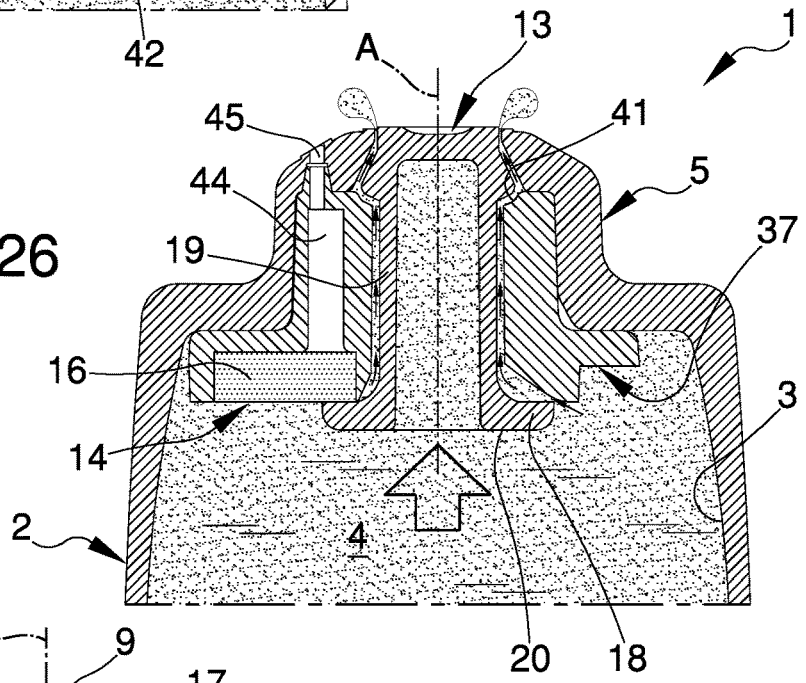
FIG. 26 is a sectional view of the detail of FIG. 24, with the dispensing valve in an opening configuration.

The first protrusion 23 moves therefore away from the external port 41, thus freeing a passage for the outflow of the fluid product 4, which passes through the notches 42 and the first housing seat 38 to exit through the external port 41 and the dispensing opening 9 (FIG. 26).

Figure 27:
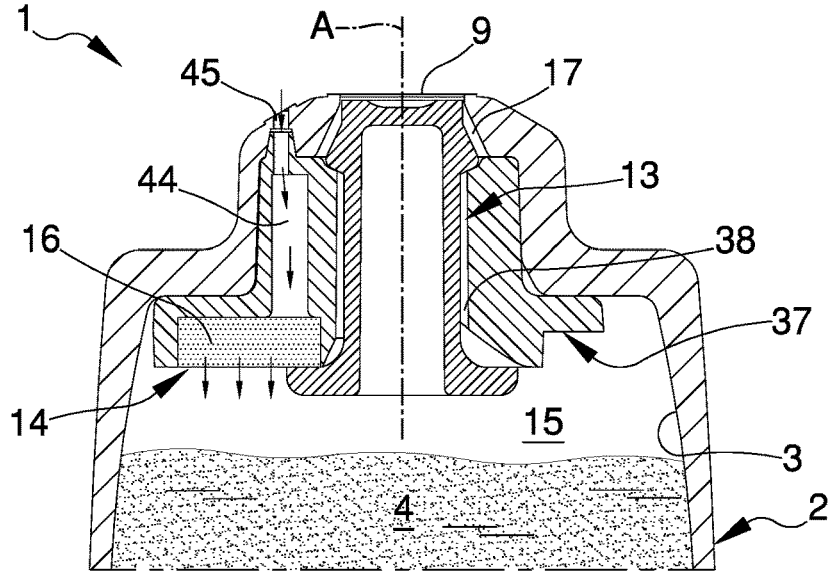
FIG. 27 is a sectional view of the detail of FIG. 24, with the dispensing valve in the closure configuration and the return valve crossed by air.

When one stops pressing the hollow body 2, the walls of the latter return to its original configuration; the pressure inside chamber 3 is reduced, the dispensing valve 13 comes back, placing the first protrusion 23 again on the external port 41 and air is recalled inside the chamber 3 through the openable section 45, the aeration channel 44 and the filtering means 16 (FIG. 27).

It has in practice been found that the described invention achieves the intended objects. In this regard, it should be noticed that the particular measure of providing a container, particularly for medical products, pharmaceuticals, cosmetics, food or the like, allows protecting the fluid product from microbial contamination for a period of time after its first use.

In particular, the particular measure of providing a dispensing valve and a return valve allows substantially maintaining unchanged the characteristics of the fluid product, ensuring its re-use.

Furthermore, the particular measure of providing the dispensing valve inserted inside the container before filling and the measure of creating the hollow body in a single body piece with the closure element allows ensuring the sterility of the packaged fluid product until the first opening of the bottle.

Furthermore, the particular measure of providing the container made in a single body piece into which the valve assembly is inserted and which is closed by sealing, makes it possible to significantly reduce production costs and, consequently, the retail price thereof.

Furthermore, the particular measure of providing a strip of containers in which the dispensing valve and the return valve are housed inside the container itself allows obtaining a solution that is not cumbersome and that requires a simple packaging, allowing maintaining very low packaging costs.

The invention claimed is:

1. Container (1), for medical products, pharmaceuticals, cosmetics, or food, comprising:

at least one hollow body (2) at least partly compressible defining at least one chamber (3) for containing at least one fluid product (4) and provided with at least one neck (5);

at least one closure element (6) made in a single body piece with said hollow body (2) and provided with at least one attachment portion (7) which, in a packaging configuration, is associated with said hollow body (2) along at least one predefined breaking line (8) adapted to allow the separation of said closure element (6) from said hollow body (2) in a configuration of separation in which on said hollow body (2) is formed at least one dispensing opening (9) of said fluid product (4);

at least one dispensing valve (13) adapted to allow the outflow of said fluid product (4) through said dispensing opening (9) and at least one return valve (14) adapted to allow the one-way flow of air (15) towards said chamber (3), wherein said return valve (14) comprises filtering means (16) adapted to filter said air (15) entering said chamber (3);

said dispensing valve (13) and said return valve (14) are housed in at least one dispensing channel (17) formed in said neck (5) and communicating with said chamber (3) and with said dispending opening (9); and said return valve (14) is integrated in said dispensing valve (13) to form a valve assembly (13, 14) arranged in said dispensing channel (17) in the proximity of said dispensing opening (9).

2. Container (1) according to claim 1, wherein said dispensing valve (13) comprises at least one internal through duct (28) adapted to allow the entry of said air (15) into said chamber (3) and in which said return valve (14) is housed.

3. Container (1) according to claim 2, wherein said return valve (14) comprises said filtering means (16) housed in an immoveable manner in said internal duct (28) for the filtration of said air (15) entering said chamber (3).

4. Container (1) according to claim 2, wherein said return valve (14) comprises at least one support (29) which can be inserted in an immoveable manner in said internal duct (28), said support (29) being associated with said filtering means (16) of said air (15) entering said chamber (3).

5. Container (1) according to claim 1 wherein the closure element (6) comprises at least one re-closure portion (10) joined to said attachment portion (7) and positionable to re-close said dispensing opening (9).

6. Container (1) according to claim 5, wherein said re-closure portion (10) has a substantially cap shape and comprises at least one lateral wall and at least one bottom wall, in which said lateral wall can be fitted on said neck (5) in a re-closure configuration.

7. Container (1) according to claim 1 further comprising at least one breakable attachment area (31) adapted to connect said container (1) to at least one adjacent container (1) to form a strip (32) of containers (1).

8. Strip (32) of containers, comprising a plurality of containers (1) according to claim 1 associated with each other in correspondence of at least one breakable attachment area (31).

9. Container (1) according to claim 1, wherein said dispensing valve (13) is moveable along at least one longitudinal axis (A) of said dispensing channel (17) between at least one closure configuration in which said dispensing valve (13) is arranged to prevent the flow of said fluid product (4) through said dispensing channel (17) and at least one opening configuration in which said dispensing valve (13) is displaced along said longitudinal axis (A) to allow the flow of said fluid product (4) through said dispensing channel (17).

10. Container (1) according to claim 1, wherein said movement of said dispensing valve (13) from said closure configuration to said opening configuration takes place by increasing the pressure inside said chamber (3), said hollow body (2) being pressable to allow the reduction in volume of said chamber (3) for the dispensing of said fluid product (4).

11. Container (1) according to claim 1, wherein said dispensing valve (13) comprises at least a first substantially annular protrusion (23) projecting from at least one external surface (25) of said dispensing valve (13) and adapted to abut in said closure configuration against at least one respective second substantially annular protrusion (24) formed on at least one internal surface (26) of said dispensing channel (17).

* * * * *